US005204612A

United States Patent [19]

Lingstaedt

[11] Patent Number: 5,204,612

[45] Date of Patent: Apr. 20, 1993

[54] CURRENT SOURCE CIRCUIT

[75] Inventor: Ernst Lingstaedt, Zorneding, Fed. Rep. of Germany

[73] Assignee: Eurosil electronic GmbH, Eching, Fed. Rep. of Germany

[21] Appl. No.: 743,026

[22] Filed: Aug. 9, 1991

[30] Foreign Application Priority Data

Oct. 29, 1990 [DE] Fed. Rep. of Germany ..... 4034371

[51] Int. Cl.[5] ..... G05F 3/16

[52] U.S. Cl. ..... 323/317; 323/315

[58] Field of Search ..... 323/317, 312, 313, 315, 323/316, 267, 268, 269; 307/296.1, 296.6, 296.7, 296.8

[56] References Cited

U.S. PATENT DOCUMENTS 4,182,962 1/1980 Taguchi et al. ..... 307/296.6
4,706,013 11/1987 Kuo ..... 323/316
4,864,217 9/1989 Bird ..... 323/317
5,021,692 6/1991 Hughes ..... 323/316

FOREIGN PATENT DOCUMENTS 3110167 1/1982 Fed. Rep. of Germany .

OTHER PUBLICATIONS

Patent Abstract of Japan, vol. 13, No. 239, Jun. 6th, 1989; JP 1-42717 A.

IEEE Journal of Solid State Circuits, vol. SC-12, No. 3, Jun. 17th, 1977; pp. 224-231; E. Vittoz et al., "CMOS Analog Integrated Circuits Based on Weak Inversion Operation".

*Primary Examiner*—Steven L. Stephan
*Assistant Examiner*—Jeffrey Sterrett
*Attorney, Agent, or Firm*—Spencer, Frank & Schneider

[57] ABSTRACT

A current having a high negative temperature coefficient can be tapped from a current source circuit connected as a loop out of two current mirror circuits and having a resistor. Furthermore, a current source circuit of this type made with CMOS technology has a high current requirement. The invention permits a reduction of these drawbacks by replacing the resistor with a connected capacitor.

11 Claims, 5 Drawing Sheets

CURRENT SOURCE CIRCUIT

BACKGROUND OF THE INVENTION

The invention relates to a current source circuit having a first, second, third and fourth field effect transistor, where the first and second field effect transistors are of a first channel type and the third and fourth field effect transistors of a second channel type and the series-connected channel sections of the first and fourth field effect transistors and of the second and third field effect transistors form a first and second main current path respectively, where the control electrodes of the first and third field effect transistors are connected respectively to the first main current path and the control electrode of the second field effect transistor, and to the second main current path and the control electrode of the fourth field effect transistor in order to form a first and second current mirror respectively, and where a fifth field effect transistor is controlled by the first current mirror to tap a first source current.

A current source circuit of this type is known from the periodical "*IEEE Journal of Solid State Circuits*", June 1977, pages 224 to 231, particularly FIG. 8 on page 228. This circuit is shown in FIG. 1, where the field effect transistors T1 to T4 combine with the resistor R1 to form a reference current source. Here, the two n-channel transistors T1 and T2 represent a first current mirror. The two p-channel transistors T3 and T4 form in addition a second current mirror.

For the first current mirror "T1, T2", the following applies:

$$i2 = i1 \cdot \frac{W/L\ [T2]}{W/L\ [T1]} \quad (1)$$

where W/L [·] state the channel width/channel length ratios of transistors T1 and T2 respectively. Identical transistor sizes for T1 and T2 result in identical current i2 and i1.

For further analysis and for sake of simplicity, i2 is considered to be equal to i1. However, the principle of operation will be maintained even if i2 is bigger or smaller than i1.

For the current i1 in connection with the second current mirror "T3, T4", the value is obtained using the following formula:

$$i1 = \frac{K \cdot T \cdot \frac{W/L\ [T4]}{W/L\ [T3]}}{q \cdot R1} \quad (2)$$

where K states the Boltzmann's constant, T the absolute temperature and q the electron charge. With a resistance of R1=MΩ and a W/L ratio of 8 for the two transistors T4 and T3, the result at a room temperature of 300° K. is a current i1 of $5.4 \cdot 10^{-8}$ A.

The above equation (2) applies as long as the two transistors T3 and T4 are in the weak inversion range. This equation also shows that the current i1 has at room temperature a positive temperature coefficient of approx. +3000 ppm/K. when the resistor R1 is assumed to be constant and temperature-independent. For the resistor R1, a p-well resistor is mostly used that has a positive temperature curve. The result for the current i1 is typically a negative temperature coefficient in the range of approx. −5000 to −15000 ppm/K.

In accordance with FIG. 1, a current i3 is tapped via an n-channel field effect transistor T5 of the reference current source, said current being-depending on the selected size ratio of the first current mirror (W/L [T5]/W/L [T1]-a fraction or a multiple of the current i1, with the current i3 naturally having the same temperature dependence as current i1.

As shown above, the current i1 is 54 nA with the stated circuit dimensions. However, since current i2 and i1 are identical, this reference current source according to FIG. 1 itself already consumes a current of approx. 0.1 μA. This current input is however too high for many applications.

One possibility of reducing the current consumption of this known reference current source is to reduce the W/L ratio of the two transistors T4 and T3. This reduces the voltage drop across the resistor R1 and hence, with a given resistance R1, also the current consumption of the circuit. However, this option is tightly circumscribed because very high percentage dispersions of the voltage drop occur at this resistor R1 and hence for the current i1 too when the W/L ratio of the transistors T4 and T3 is very low.

A further possibility is to increase the resistance of R1 to, for example, 10 MΩ, as a result of which the current input of the reference current source drops to around 10 nA, which can therefore be tolerated in "low power" circuits too.

Since this resistor R1 is however—as stated above—usually formed by a p-well resistor, and its surface resistance is only about 2 kΩ for technological reasons, a disproportionately large chip area (approx. 1 $mm^2$) would be required for a resistance of that magnitude, which is of course also undesirable.

Finally, there is the possibility of reducing the current input by using a high-value resistor R1 in the form of a specially generated layer, for example implanted polysilicon with high surface resistance and hence low space requirement. The provision of a high-value polyresistor of this type does however require a special mask and also additional process steps, and thus causes increased costs. A resistor of this type can also only be manufactured with relatively wide tolerances, so that the current i3 tappable via the transistor T5 is also subject to heavy dispersion, and the circuit is not suitable for applications in which the current i3 should remain largely constant.

SUMMARY OF THE INVENTION

The object of the invention is to provide a current source circuit of the type mentioned at the outset that permits a current tap where the current is largely constant with an overall low current consumption by the current source circuit.

According to the invention, there is provided a first pair of field effect transistors, wherein said field effect transistors are connected in series in the first main circuit between the fourth field effect transistor of the second current mirror and an operating voltage source, where a first capacitor is connected parallel to the channel section of that field effect transistor of the first field effect transistor pair which is connected to the operating voltage source, wherein a second capacitor connects the connected control electrodes of the first and second field effect transistors to the reference potential of the circuit, and wherein the control electrodes of the field effect transistors of the first field effect transistor pair are supplied with clock signals in phase opposition.

Accordingly, the substance of the invention is the simulation of the resistor R1 in accordance with FIG. 1 by a connected capacitor. Since a stable quartz frequency of, for example, 32.768 kHz is available in many integrated circuits, a resistance of approx. 10 MΩ can easily be achieved with a small capacitance of several pF. For example, a capacitive resistance of 10.1 MΩ is obtained with a frequency f of 32.768 kHz and a capacitance of 3 pF.

The low chip area of 3 pF in a capacitor of this type is particularly noteworthy, the capacitor thus requiring only a fraction (less than 1%) of the area of an ohmic (p-*well*) resistor with the same resistance value.

Furthermore, a thin silicon dioxide layer (gate oxide) is generally used as the dielectric for a capacitor of this type, this layer being produced anyway when an integrated CMOS circuit is made. The layer thickness of this oxide is typically several 100 Å and is therefore produced within close tolerances of less than +/−5%. It is therefore possible to produce capacitors with very low dispersions of the absolute value without additional process steps, so that when a constant clock frequency is assumed, a reference current source with low dispersion of the current i3 tapped via transistor T5 can be produced with a low current consumption by the circuit itself—for example less than 10 nA—and with a low chip area requirement.

In an advantageous embodiment of the invention, a current source circuit is obtained that supplies an output current with presettable temperature coefficients. The temperature coefficient of this output current is determined by the capacitors provided in the circuit array controlled by the second current mirror, its prefixed sign being given by the phase position of the clock signals supplied to this circuit array.

An arrangement of further circuit arrays of this type controlled by the second current mirror permits in another advantageous embodiment of the invention tapping of further output currents with selectable temperature coefficients and prefixed signs. It is therefore possible to provide on one integrated circuit current sources with differing temperature curves.

Furthermore, this provides another simple possibility of generating output currents with differing negative temperature coefficients, their values being predetermined by the dimensions of the transistors of the current mirrors involved.

The following in conjunction with the Figures shall explain and illustrate on the basis of embodiments the current source circuit in accordance with the invention together with its advantages.

In the Figures, components with corresponding functions have been give identical designations.

DESCRIPTION OF THE PREFERRED EMBODIMENTS

Figure 1:
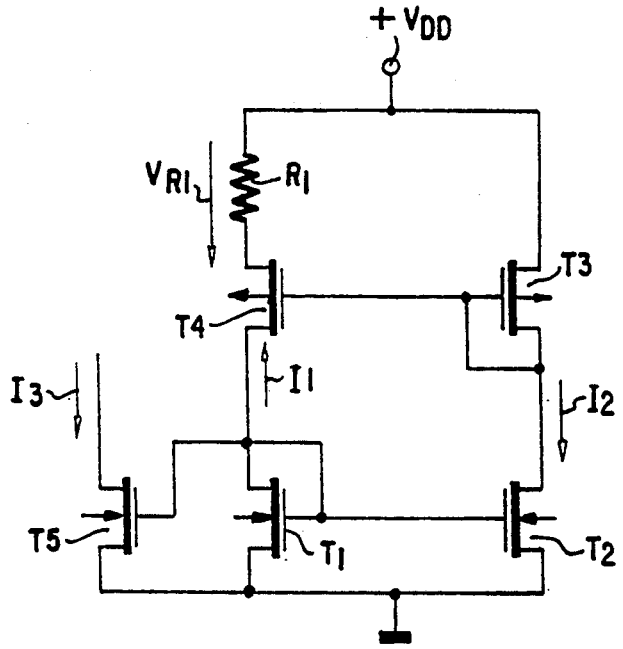
FIG. 1 (PRIOR ART)
FIG. 1 shows a current source circuit according to the prior art.
Figure 2:
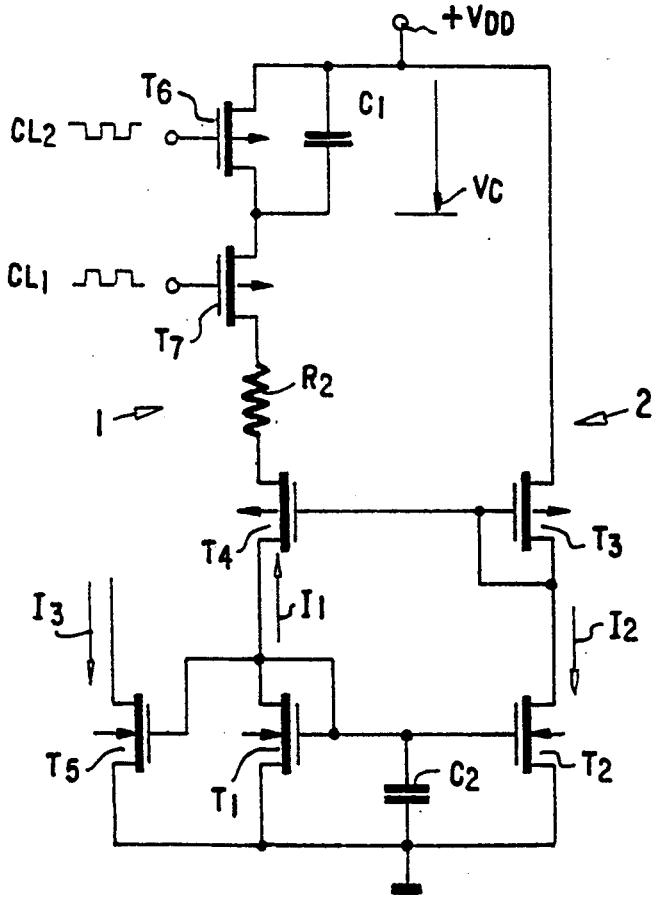
FIG. 2 shows an embodiment of the current source circuit in accordance with the invention.

The design principle of the current source circuit in accordance with the invention as shown in FIG. 2 corresponds to that of FIG. 1 with 5 field effect transistors T1 to T5. The two n-channel transistors T1 and T2, and the two p-channel transistors T3 and T4 form a first and a second current mirror respectively, for which reason the control electrode of transistor T1 is connected to its drain electrode and the control electrode of transistor T3 also to its drain electrode. In addition, the control electrodes of transistors T1 and T2 and of T3 and T4, each pair forming a current mirror, are connected to one another. The two transistors T2 and T3 are connected in series via their channel sections and connect the reference potential of the circuit to an operating voltage source $V_{DD}$ by the source electrode of transistor T2 being connected to the reference potential and the source electrode of transistor T3 being connected to the operating potential. As a result, these two transistors T2 and T3 form a main current path 2 connecting the reference potential to the operating voltage potential $V_{DD}$. A further main current path 1 parallel hereto is obtained by series connection of the transistor T1, the transistor T4, a resistor R2, and two p-channel transistors T6 and T7 connected in series by their channel sections, the above being connected to one another in the stated sequence starting from the reference potential of the circuit, with the source electrode of transistor T6 being connected to the operating potential of the operating voltage source $V_{DD}$. Finally, an n-channel transistor T5 is provided whose gate electrode is connected to the first current mirror via the gate electrode of the transistor T1 and whose source electrode is likewise connected to the reference potential of the circuit. A current i3 can be tapped from the drain electrode of this transistor T5, the size of said current corresponding to that of the current i1 flowing in the main current path 1 when the transistors T1 and T5 are identically dimensioned. When the circuit is in the balanced state, the current i1 corresponds to the current i2 flowing in the main current path 2.

Furthermore, a first and a second capacitor C1 and C2 are provided according to FIG. 2, the first capacitor C1 being arranged parallel to the channel section of transistor T6 and the second capacitor C2 being connected by its first terminal to the reference potential of the circuit and by its second terminal to the control electrode of the first or second transistor T1 or T2.

The two control electrodes of transistors T6 and T7 are supplied with clock signals C11 and C12 in opposite phase to one another, i.e. if the gate electrode of transistor T7 receives a low signal (L level), a high signal (H level) is applied at the same time to the gate electrode of the other transistor T6.

The following now explains the mode of operation of the circuit array according to FIG. 2:

The capacitor C1 is discharged through the transistor T6 during the clock phase with L level, since the transistor T6 is switched to the conducting state while the transistor T7 is in the non-conducting state. In the subsequent clock phase, the control electrode of transistor T6 receives an H level while the gate electrode of transistor T7 receives an L level at the same time, so that the capacitor C1 now charges up to a voltage $V_C$ obtained from the size ratios of transistor T1 to T4.

The resistor R2 in the main current path 1 has in this circuit only the function of limiting the current and is intended to prevent the occurrence of a short-term excessive current flow in the case of a flank change of the clock signal Cl1 from the H to the L level in transistors T1 to T4. The value of this resistance R2 is not critical here and can therefore be formed itself by a correspondingly dimensioned p-channel transistor T7, for example, that has the required resistance value in the conducting state. Since in this circuit the current i1 is not constant in time compared with the circuit according to FIG. 1, but pulsates in time with the applied clock frequency, whereas the current i3 tapped via T5 should not normally be subject to any time fluctuations, the capacitor C2 already mentioned above is switched from the common gate terminal of transistors T1, T2 and T5 as the smoothing capacitor to the reference potential, the value of which is also in the order of several pF.

In the circuit in accordance with the invention as shown in FIG. 2, therefore, it is possible with a minimum surface requirement and a low current consumption to generate an output current i3 that has only low production-related tolerances and whose absolute value is almost exclusively dependent on the selected transistor dimensions of the transistors T1 to T5, the capacitance of the capacitor C1 and the frequency of the applied clock signal Cl1 and Cl2. The achievable temperature coefficient of the output current i3 is however fixed in advance and is around +3000 ppm/K, since the capacitor C1 used itself has only a very low temperature coefficient.

Figure 3:
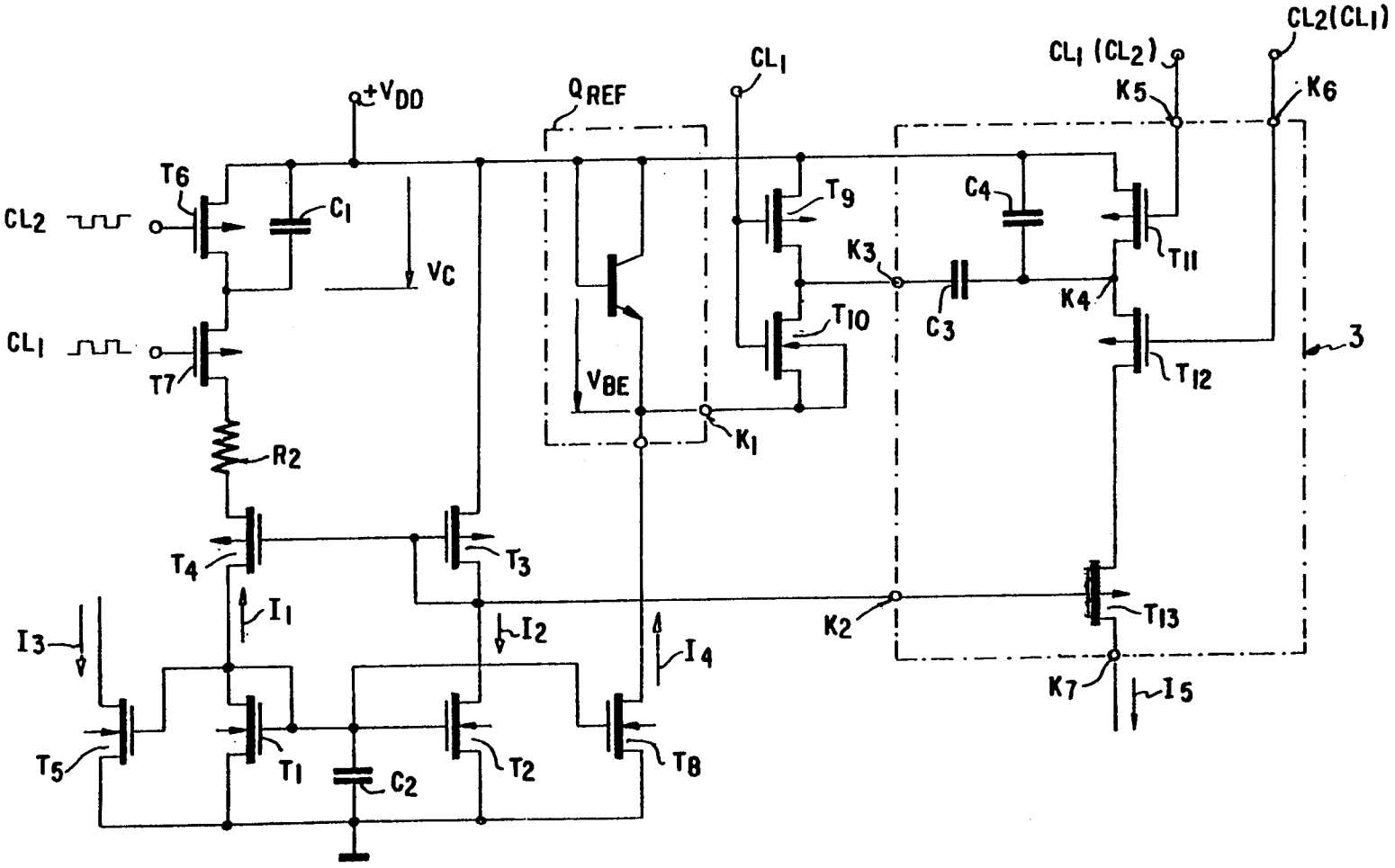
FIG. 3 shows a circuit diagram of a further embodiment of the invention for generating output currents with predetermined temperature coefficients.

The embodiment according to FIG. 3 contains, with the switching elements T1 to T7, C1 and C2, and R2 a circuit component that corresponds to the circuit array according to FIG. 2. This component is therefore not dealt with in detail in the following. In addition, this circuit array contains a current source transistor T8 controlled by the first current mirror T1 and T2, said current source transistor being designed as an n-channel field effect transistor. This transistor T8, whose source electrode is connected to the reference potential of the circuit, supplies an emitter current i4 for an npn bipolar transistor Q1 used as a reference voltage source $Q_{ref}$. For this purpose, both its base electrode and its collector electrode are connected to the potential of the operating voltage source $V_{DD}$ in order to thereby generate at the circuit nodal point K1 the base-emitter voltage $V_{BE}$ of transistor Q1 that is required as the temperature-dependent reference voltage. A series connection made up of two field effect transistors T9 and T10 connects this circuit nodal point K1 to the operating voltage source $V_{DD}$, with the transistor T9 connected to this potential being of the p-channel type and the transistor T10 connected to the circuit nodal point K1 being of the n-channel type. The connecting point of the two channel sections of these transistors T9 and T10 leads to a terminal K3 of a circuit array 3. The two control electrodes of these two transistors T9 and T10 are connected to one another and are triggered by a clock signal Cl1. As a result, the terminal K3 is connected either to the reference voltage $V_{BE}$ (Cl1=H level) or to the operating voltage source $V_{DD}$ (Cl1=L level) depending on the state of this clock signal Cl1.

A current i5 can be tapped from the circuit array 3, onto which current a certain temperature coefficient can be superimposed, as shown below. For this purpose, this circuit array 3 contains a current source transistor T13 of p-channel type and controlled by the second current mirror T3 and T4, with the drain electrode of said transistor T13 supplying the said output current i5 and its source electrode being connected to the operating voltage source $V_{DD}$ via a series connection comprising two p-channel field effect transistors. The control electrode of transistor T11 is supplied with the clock signal Cl1 and the control electrode of transistor T12 with the clock signal Cl2 in opposite phase to clock signal Cl1, or conversely the clock signal Cl2 is supplied to transistor T11 and the clock signal Cl1 to transistor T12. The clock signal lines are connected to the terminals K5 and K6 of the circuit array 3. The output current i5 is tapped at a terminal K7.

A first capacitor C4 of this circuit array 3 is parallel to the channel section of transistor T11, corresponding to capacitor C1, while a second capacitor C3 connects the terminal K4 of the two channel sections of transistors T11 and T12 to the nodal point K3.

The mode of operation of the circuit array according to FIG. 3 is as follows:

The field effect transistors T11, T12 and T13 and the capacitors C3 and C4 supply, in interaction with the previously described circuit in accordance with FIG. 2, an output current i5 whose temperature curve is largely predetermined by the dimensions of the capacitors C3 and C4 and by the reference voltage $V_{BE}$ and its temperature dependence.

The base-emitter voltage $V_{BE}$ of the vertical npn transistor Q1 made using integrated CMOS technology is subject only to low fluctuations in view of the given production process involving the parameter dispersions to be expected with several production runs. The absolute value and the temperature curve of this voltage are affected in addition only by the current density, i.e. the ratio of the emitter surface of the transistor Q1 to the emitter current i4. Since the current i4, the level of which matches that of current i1 when transistor T1 and T8 have equal dimensions, is however only subject to low production fluctuations, the absolute value and the temperature dependence of the reference voltage $V_{BE}$ of the reference voltage source $Q_{ref}$ can be predetermined to a very high precision with the given circuit dimensions.

If the capacitor C3 of the circuit array 3 is initially discounted, it can be seen that the arrangement of the switching elements T11, T12, T13 and C4 corresponds exactly to the circuit array of the switching elements T4, T6, T7 and C1, meaning that with the dimensions of the capacitor C4 of the transistors T11 to T13 equal to those of the capacitor C1 and the transistors T4, T6 and T7, the output current i5 and its temperature curve match the current i1.

Figure 4:
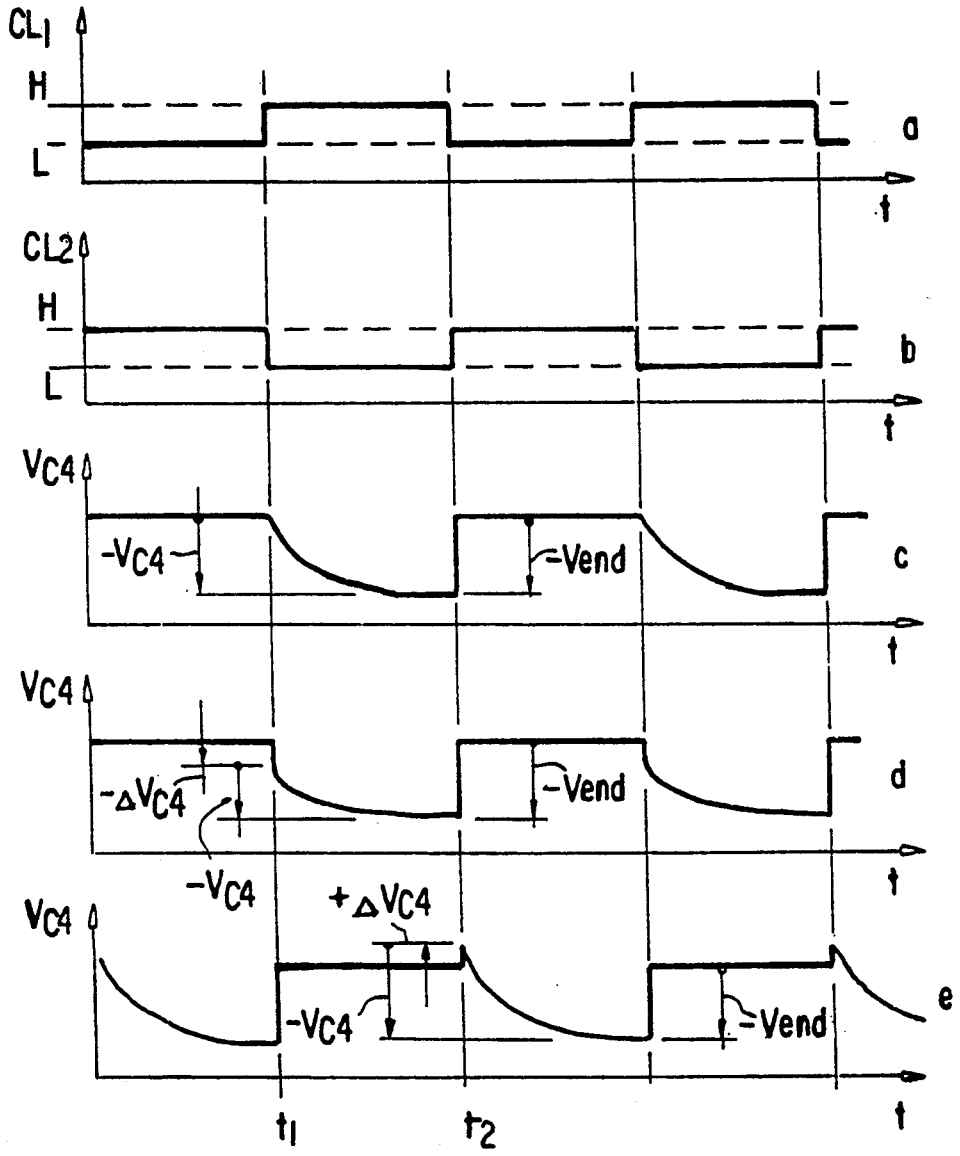
FIG. 4 shows voltage/time graphs to explain the mode of operation of the circuit according to FIG. 3.

Diagrams a, b according to FIG. 4 show the level development of the clock signals Cl1 and Cl2 in opposite phase to one another. The voltage diagram c here shows the voltage curve $V_{C4}$ of the capacitor C4. At the time $t_1$, this capacitor C4—C3 not being present—would be charged by a voltage quantity $-V_{C4}$ up to a final voltage $-V_{end}$ by time $t_2$.

If the capacitor C3 is now included in the calculation, the following occurs, assuming that the transistors T9, T10 and T11 are triggered by the clock signal C11 in accordance with FIG. 4a, and transistor T12 by the inverted clock signal $C1^2$ in accordance with FIG. 4b:

While the clock signal C11 is at the L level, the capacitor C4 is discharged via the transistor T11 to the operating potential $V_{DD}$ and at the same time the circuit nodal point K3 is also held at the operating potential of $V_{DD}$ by transistor T9, meaning that the capacitor C3 is also discharged. When the flank of the clock signal C11 changes from the L to the H level, the circuit nodal point K3 is connected to the reference voltage $V_{BE}$, and hence the capacitor C4 is abruptly charged to a differential voltage $-V_{C4}$ via the coupling capacitor C3, with the following value being obtained for this differential voltage $-V_{C4}$:

$$-V_{C4} = V_{BE} \cdot \frac{C_3}{C_3 + C_4}. \quad (3)$$

The voltage curve at this capacitor C4 is shown by the voltage diagram d according to FIG. 4. This shows that the further voltage change $-V_{C4}$ up to the final value $-V_{end}$ is, due to the initial voltage $-V_{C4}$, lower than in the voltage diagram c without the compensation by the capacitor C3. The initial result of this is that the tappable current i5 is lower than the current i1.

Since the differential voltage $-V_{C4}$—as can be seen in the equation (3)—corresponds to a fraction of the reference voltage $V_{BE}$, this differential voltage $-V_{C4}$ follows the temperature development of this reference voltage $V_{BE}$, meaning that with increasing temperature the differential voltage $-V_{C4}$ also falls. As a result, however, the change voltage $-V_{C4}$ is greater, meaning that the change reversal of the capacitor C4 from the initial value $-V_{C4}$ to the end value $-V_{end}$ is over a wider voltage range and so increases the tappable current i5. For the output current i5, therefore, the result is a positive temperature coefficient, its value only being determined by the ratio of the capacitance values of capacitors C3 and C4 with the known temperature curve of the reference voltage $V_{BE}$.

If however the clock signals are changed round at the terminals K5 and K6 in the circuit according to FIG. 3, meaning that transistor T11 receives the clock signal C12 and the transistor T12 the clock signal C11, the result is a negative temperature coefficient for the output current i5. The corresponding voltage curve for the capacitor C4 is shown in diagram e of FIG. 4.

When the clock signal C11 switches to the H level at time $t_1$, the terminal K3 is connected via the transistor T10—switched to the conducting state—to the reference voltage $V_{BE}$, while at the same time the capacitor C4 is discharged via the transistor T11 to the operating potential $V_{DD}$, since the clock signal C12 switches to the L level, meaning that the capacitor C3 is charged at the same time up to the reference voltage $V_{BE}$.

The transistor T11 is now non-conducting when the flank of the clock signal C12 changes from the L to the H level. At the same time, however, the clock signal C11 changes from the H to the L level, as a result of which the circuit nodal point K3 is connected to the operating voltage potential $V_{DD}$ via the transistor T9. The two capacitors C3 and C4 are therefore connected in parallel at this time, and since the capacitor C3 was previously charged to the reference voltage $V_{BE}$, the parallel connection of the two capacitors C3 and C4 is recharged to the voltage difference $+V_{C4}$. Charging of this capacitor C4 to the final voltage value $-V_{end}$ is therefore over a wider voltage range $-V_{C4}$ than in the case of the circuit without temperature compensation according to FIG. 4c, and the tappable output current i5 is therefore greater at first. With increased temperature, however, the reference voltage $V_{BE}$ becomes smaller and the initial charge voltage $+V_{C4}$ is therefore reduced, meaning that recharging the capacitor C4 from the initial voltage $+V_{C4}$ to the final voltage $-V_{end}$ is with increasing temperature over a narrower voltage range and thus the tappable current i5 also becomes smaller as the temperature increases, meaning that a negative temperature coefficient results for i5.

Figure 5:
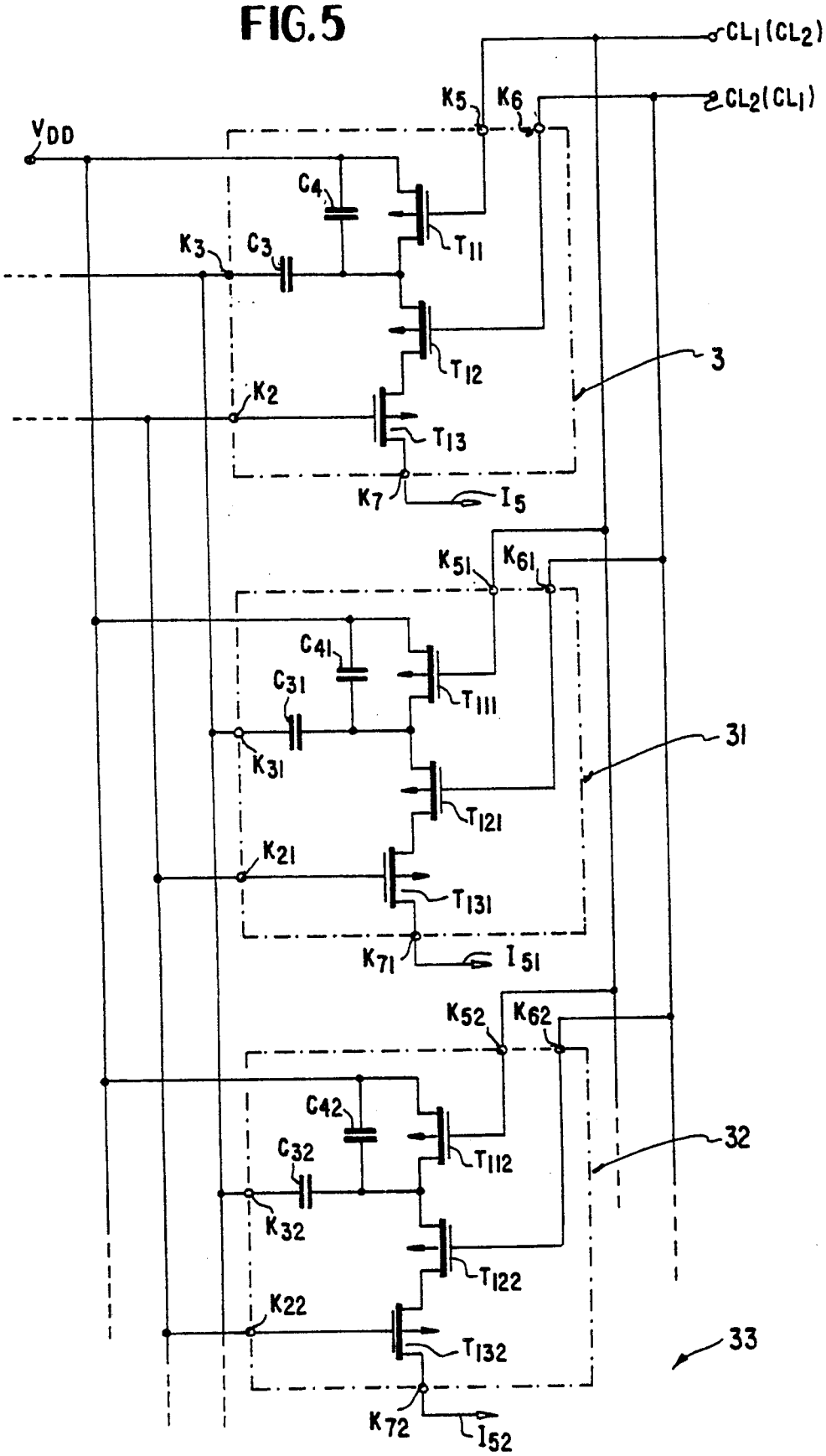
FIG. 5 shows a further embodiment of the invention for generating output currents with negative temperature coefficients.

If further circuit arrays $3_1$, $3_2$, $3_3$, . . . are connected in parallel to the terminals K2, K3, K5 and K6 of the circuit array 3 in accordance with FIG. 3, output currents i5, $i5_1$, $i5_2$, $i5_3$, . . . with differing temperature behavior can be generated on one and the same integrated circuit. A current source circuit of this type is shown in FIG. 5, where the reference voltage source $Q_{ref}$ and the switching elements T1 to T10, Cl and C2 are not illustrated. Each of these circuit arrays $3_1$, $3_2$, $3_3$, . . . correspond in their design to the circuit array 3 according to FIG. 3. They therefore contain transistors $T11_1$, $T12_1$, $T13_1$, $T11_2$, $T12_2$, $T13_2$, and capacitors $C3_1$, $C4_1$, $C3_2$, $C4_2$, . . . A current $i5_1$, $i5_2$, $i5_3$, . . . can be withdrawn at the terminals $K7_1$, $K7_2$, $K7_3$, . . . respectively.

Figure 6:
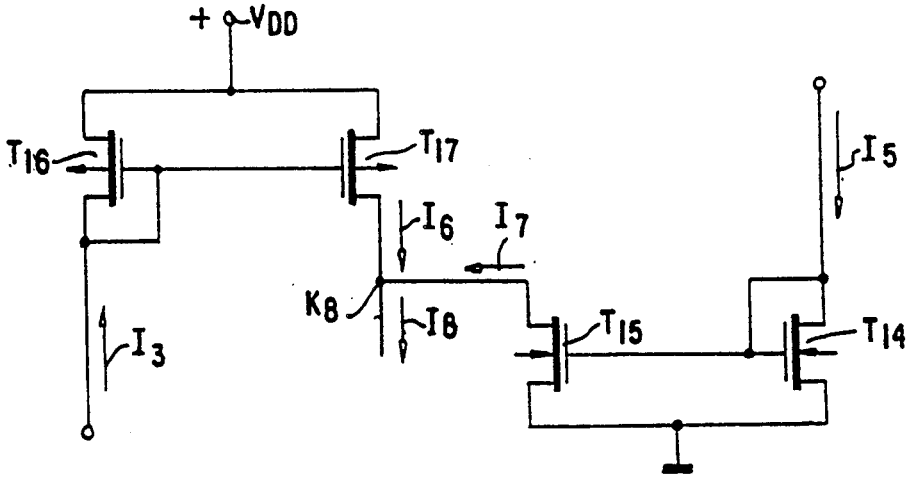
FIG. 6 shows a circuit diagram of a further embodiment of the invention for generating a current with negative temperature coefficient.

FIG. 6 now shows a circuit with which the current source circuit according to FIG. 3 can be supplemented for generation of an output current with negative temperature coefficients. It is assumed here that the circuit according to FIG. 3 supplies an output current i5 with positive temperature coefficient. In FIG. 6, only the circuit paths supplying the output current i3 and the output current i5 are shown instead of the current source circuit according to FIG. 3. The output current i3 represents the input current for a current mirror made up of two p-channel field effect transistors, while the output current i5 is passed as an input current into a further current mirror made up of two n-channel field effect transistors T14 and T15. The first current mirror T16, T17 is connected to the operating voltage source $V_{DD}$ and supplies via transistor T17 an output current i6. The second current mirror T14, T15 by contrast is connected to the reference potential of the circuit and supplies via the transistor T15 an output current i7. These two output currents i6 and i7 are added up at a circuit nodal point K8 into an output current i8.

Since the output current i3 and hence also the output current i6 have a very low positive temperature coefficient, while the output current i5 can have a very high positive temperature coefficient depending on the dimensions of the capacitors C3 and C4, the total output current i8 tappable from the circuit according to FIG. 6 and representing the difference between the currents i6 and i7 will have a negative temperature coefficient whose value is predetermined only by the dimensions of transistors T15 and T17.

It is therefore possible, for example, to dimension these transistors T15 and T17 such that the current i7 is greater than the current i6 at a certain temperature. If no current is tapped at the circuit nodal point K8 in this case, i.e. if this circuit nodal point K8 is not subjected to load from a connected current miroor, for example, for example, the voltage potential at this circuit nodal point K8 is—below a limit temperature determined by the dimensions—the same as the voltage potential of the operating voltage source $V_{DD}$, and it changes to the reference potential of the circuit when this limit temperature is exceeded. In this way, a temperature sensor can be made with simple means using this circuit.

Figure 7:
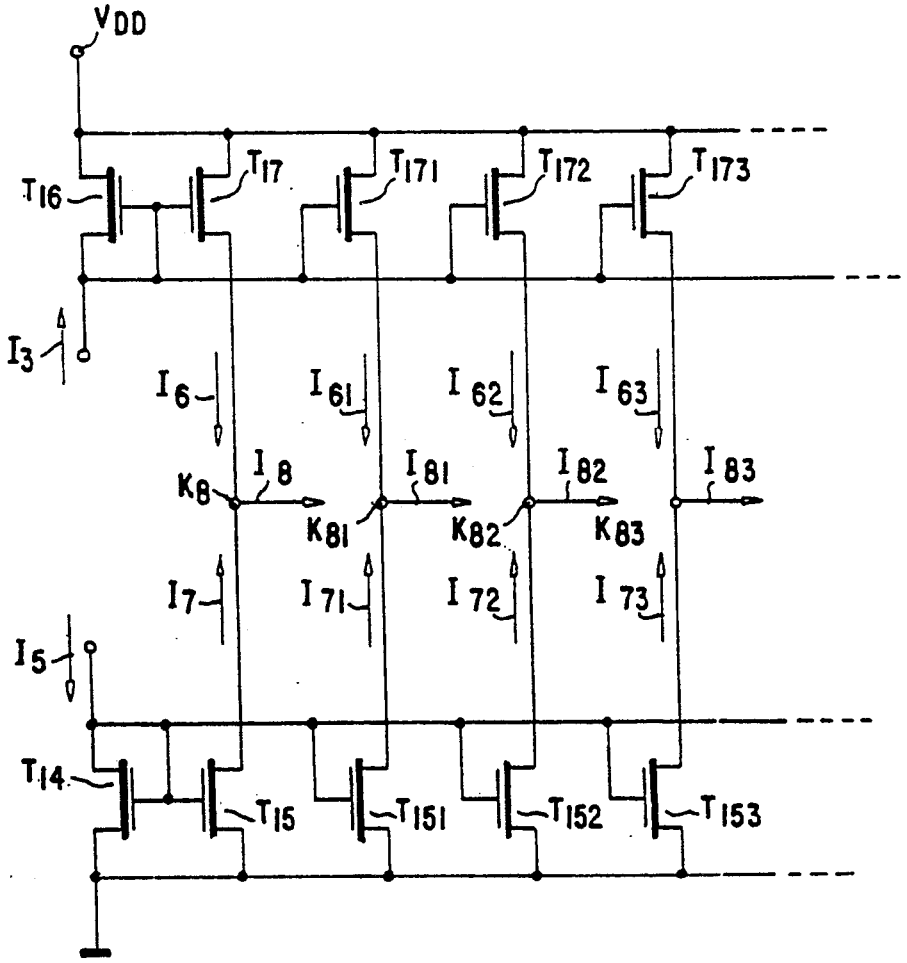
FIG. 7 shows a circuit diagram for generating several currents with different negative temperature coefficients.

FIG. 7 shows a circuit expanded in accordance with FIG. 6, in which further transistors $T15_1$, $T15_2$, $T15_3$, . . . and $T17_1$, $T17_2$, $T17_3$, . . . are provided as current source transistors controlled by the current mirrors. The current source transistors arranged in pairs, $T15_1$ and $T17_1$, $T15_2$ and $T17_2$, $T15_3$ and $T17_3$ supply output currents $i7_1$ and $i6_1$, $i7_2$ and $i6_2$, $i7_3$ and $i6_3$ respectively, which are added up in a respective circuit nodal point $K8_1$, $K8_2$ and $K8_3$ to generate an output current $i8_1$, $i8_2$, $i8_3$, where these output currents $i8_1$, $i8_2$, $i8_3$ have different negative temperature coefficients whose values here too are only predetermined by the dimensions of the transistors $T15_1$ to $T15_3$ and $T17_1$ to $T17_3$.

The circuits described above, which have been designed in integrated CMOS technology, can also be operated with a different polarity of the operating voltage source $V_{DD}$, in contrast to the conditions described, by changing round the p- and n-channel transistors and by alterating the reference point of the reference voltage $V_{BE}$ of capacitors C1 and C4 from $+V_{DD}$ to $-V_{DD}$.

What is claimed is:

1. A current source circuit having a first, second, third and fourth field effect transistor (T1, T2, T3, T4), where said first and second field effect transistors (T1, T2) are of a first channel type and said third and fourth field effect transistors (T3, T4) of a second channel type and the series-connected channel sections of said first and fourth field effect transistors and of said second and third field effect transistors (T1, T4; T2, T3) form a first and second main current path (1, 2) respectively, where the control electrodes of said first and third field effect transistors (T1, T3) are connected respectively to said first main current path (1) and the control electrode of said second field effect transistor (T2), and to said second main current path (2) and the control electrode of said fourth field effect transistor (T4) in order to form a first and second current mirror respectively, and where a fifth field effect transistor (T5) is controlled by said first current mirror (T1, T2) to tap a first source current (i3), wherein a first pair of field effect transistors (T6, T7) is provided, said first pair of field effect transistors (T6, T7) being connected in series in said first main circuit (1) between said fourth field effect transistor (T4) of said second current mirror (T3, T4) and an operating voltage source ($V_{DD}$), wherein a first capacitor (Cl) is connected parallel with channel section of that field effect transistor (T6) of said first field effect transistor pair (T6, T7) which is connected to said operating voltage source ($V_{DD}$), wherein a second capacitor (C2) connects the connected control electrodes of said first and second field effect transistors (T1, T2) to the reference potential of the circuit, and wherein the control electrodes of said field effect transistors (T6, T7) of said first field effect transistor pair are supplied with clock signals (C11, C12) in phase opposition.

2. A current source circuit according to claim 1, wherein a reference voltage source ($Q_{ref}$) and a second pair of field effect transistors (T9, T10) are provided, said second pair of field effect transistors having opposed channel types and the series connection of these two field effect transistors being connected to said reference voltage source ($Q_{ref}$) and the connected control electrodes of said two field effect transistors (T9, T10) being supplied with a common clock signal (C11), and wherein a circuit array (3) having the following features is provided:

a) to tap a second source current (i5), said circuit array (3) comprises a source current transistor (T13) controlled by the second current mirror (T3, T4), and a third field effect transistor pair (T11, T12), the series connection of said third pair of field effect transistors (T11, T12) connecting said source current transistor (T13) to the operating voltage source ($V_{DD}$), b) furthermore a third and a fourth capacitor (C3, C4) are provided, one terminal of each of said third and fourth capacitors (C3, C4) being connected to the common terminal (K4) of the two field effect transistors of said third field effect transistor pair (T11, T12) and the other terminals of said third and fourth capacitors (C3, C4) being connected to the common terminal of the two field effect transistors of said second field effect transistor pair (T9, T10) and to the potential of said operating voltage source ($V_{DD}$) respectively, (c) said third field effect transistor pair (T11, T12) is triggered by control of the control electrodes with clock signals (C11, C12) in opposite phase.

3. A current source circuit according to claim 2, wherein further circuit arrays ($3_1$, $3_2$, . . . ) each having one current source transistor ($T13_1$, $T13_2$, . . . ) a third field effect transistor pair ($T11_1$, $T12_1$; $T11_2$, $T12_2$; . . . ) and a third and fourth capacitor ($C3_1$, $C4_1$; $C3_2$, $C4_2$; . . . ) having the features a, b, c are provided for tapping further source currents ($i5_1$, $i5_2$, . . . ).

4. A current source circuit according to Claim 2, wherein a third current mirror (T16, T17) is provided to which the first source current (i3) is supplied as the input current, wherein a fourth current mirror (T14, T15) is provided to which the second source current (i5) is supplied as the input current, and wherein to tap a third source current (i8) the output currents of the said third and fourth current mirrors are connected to a common nodal point.

5. A current source circuit according to claim 4, wherein the third current mirror (T16, T17) triggers a first group of current source transistors ($T17_1$, $T17_2$, . . . ) and the forth current mirror (T14, T15) a second group of current source transistors ($T15_1$, $T15_2$, . . . ), and wherein to tap further third source currents ($i8_1$, $i8_2$, . . . ) the output currents of said current source transistors paired from said first and second groups pass to a respective common nodal point ($K8_1$, $K8_2$, . . . ).

6. A current source circuit according to claim 3, wherein in another current source transistor (T8) is provided that is triggered by the first current mirror (T1, T2) and wherein a bipolar transistor (Q1) connected up as a diode and arranged with its emitter-collector section in series with said another current source transistor (T8) as a reference voltage source ($Q_{ref}$), the collector electrode being connected to the potential of the operating voltage source ($V_{DD}$) and the reference voltage $V_{BE}$ being tappable at the emitter electrode.

7. A current source circuit according to claim 6, wherein the current source circuit is designed using CMOS technology.

8. A current source circuit according to claim 4, wherein another current source transistor (T8) is provided that is triggered by the first current mirror (T1, T2) and wherein a bipolar transistor (Q1) connected up as a diode and arranged with its emitter-collector section in series with said another current source transistor (T8) as a reference voltage source ($Q_{ref}$), the collector electrode being connected to the potential of the operating voltage source ($V_{DD}$) and the reference voltage $V_{BE}$ being tappable at the emitter electrode.

9. A current source circuit according to claim 8, wherein the current source circuit is designed using CMOS technology.

10. A current source circuit according to claim 5, wherein another current source transistor (T8) is provided that is triggered by the first current mirror (T1, T2) and wherein a bipolar transistor (Q1) connected up as a diode and arranged with its emitter-collector section in series with said another current source transistor (T8) as a reference voltage source ($Q_{ref}$), the collector electrode being connected to the potential of the operating voltage source ($V_{DD}$) and the reference voltage $V_{BE}$ being tappable at the emitter electrode.

11. A current source circuit according to claim 10, wherein the current source circuit is designed using CMOS technology.

* * * * *